US008814451B2

(12) United States Patent
Marsden et al.

(10) Patent No.: US 8,814,451 B2
(45) Date of Patent: Aug. 26, 2014

(54) PRINTER ARRANGEMENT AND METHOD OF MANUFACTURE

(75) Inventors: Richard Marsden, Cambridgeshire (GB); Paul R. Drury, Hertfordshire (GB); Stephen Temple, Cambridge (GB)

(73) Assignee: XAAR Technology Limited, Cambridgeshire (GB)

( * ) Notice: Subject to any disclaimer, the term of this patent is extended or adjusted under 35 U.S.C. 154(b) by 1294 days.

(21) Appl. No.: 11/815,667

(22) PCT Filed: Feb. 7, 2006

(86) PCT No.: PCT/GB2006/000422

§ 371 (c)(1),
(2), (4) Date: Sep. 21, 2007

(87) PCT Pub. No.: WO2006/082445

PCT Pub. Date: Aug. 10, 2006

(65) Prior Publication Data

US 2008/0145130 A1 Jun. 19, 2008

(51) Int. Cl.

| | |
|---|---|
| ***B41J 2/235*** | (2006.01) |
| ***B41J 2/16*** | (2006.01) |
| ***B41J 2/145*** | (2006.01) |

(52) U.S. Cl.

CPC ..... *B41J 2/1631* (2013.01); *B41J 2202/19* (2013.01); *B41J 2/1623* (2013.01); *B41J 2/145* (2013.01); *B41J 2/1626* (2013.01); *B41J 2202/20* (2013.01); *B41J 2/16* (2013.01)

USPC ..... 400/124.12; 400/124.28

(58) Field of Classification Search

USPC ..... 400/124.1–124.29

See application file for complete search history.

(56) References Cited

U.S. PATENT DOCUMENTS

| | | | | |
|---|---|---|---|---|
| 5,078,517 | A * | 1/1992 | Hiroshi et al. | 400/59 |
| 5,553,952 | A * | 9/1996 | Umbach | 400/208 |
| 6,471,335 | B1 | 10/2002 | Gelbart | 347/49 |
| 7,578,576 | B2 * | 8/2009 | Inaoka et al. | 347/47 |
| 2002/0042994 | A1 | 4/2002 | Ito et al. | 29/890 |
| 2002/0048477 | A1 * | 4/2002 | Udagawa et al. | 400/118.2 |
| 2006/0132540 | A1 * | 6/2006 | Baker et al. | 347/47 |

FOREIGN PATENT DOCUMENTS

| | | |
|---|---|---|
| JP | 2002-192732 | 7/2002 |
| WO | WO 01/60627 A3 | 8/2001 |

OTHER PUBLICATIONS

International Preliminary Report on Patentability for International Application No. PCT/GB2006/000422, dated Aug. 16, 2007.

International Search Report of International Application No. PCT/GB2006/000422, mailed Aug. 30, 2006.

Written Opinion of the International Searching Authority of PCT/GB2006/000422, mailed Aug. 30, 2006.

Notification of Reason for Rejection for Japanese Application No. 2007-553708, dated Mar. 29, 2011, with English-language translation.

* cited by examiner

*Primary Examiner* — David Banh

(74) *Attorney, Agent, or Firm* — Marshall, Gerstein & Borun LLP

(57) ABSTRACT

A mounting arrangement for mounting a printer component to a support, using a foil including a number of mounting apertures, into which pins are inserted to provide alignment. The engagement of the pins in the aperture causes local deformation of the foil, the resulting forces acting to align the pins to an accuracy which can be greater than that to which the foil is manufactured.

31 Claims, 7 Drawing Sheets

PRINTER ARRANGEMENT AND METHOD OF MANUFACTURE

BACKGROUND OF THE INVENTION

1. Field of the Invention

The present invention relates to printing machines, and particularly but not exclusively to printing machines using multiple printheads, for example of the drop-on-demand, ink-jet variety having an array of nozzles for droplet ejection.

2. Related Technology

It is frequently desirable in drop on demand printing to align a plurality of printer components, typically printheads, to provide contiguous print swaths. Such alignment must be performed very accurately to minimise visible errors on the printed substrate. WO 01/60627 for example describes a method of aligning printheads using tapered screw fittings. Prior art methods of alignment can however be time consuming and/or require parts manufactured to extremely high tolerances.

SUMMARY OF THE INVENTION

The present invention seeks to provide an improved mounting arrangement and method for a printer component.

According to a first aspect therefore, there is provided a mounting arrangement for mounting a printer component to a substantially rigid base component, said arrangement comprising a foil member attached to one of the printer component or the base component, said foil including one or more mounting apertures, one or more mounting pins attached to the other of the printer component or the base component, said pins adapted to engage said apertures, wherein engagement of said mounting pins with said mounting apertures causes local deformation of said foil, said deformation providing a locating force on said pins so as to urge said printer component into alignment with said base component in a plane substantially parallel to said foil.

The foil is preferably between 0.1 mm and 0.5 mm in thickness, more preferably 0.25 mm in thickness. The foil can be of any material which gives the desired deformation properties, but is preferably metal, and preferably a beryllium copper alloy, or a bronze.

A second aspect of the invention provides a method for mounting a first printer component to a support, the method comprising, attaching to one of the printer component or the support a foil having one or more mounting apertures, arranging on the other of the printer component or the support one or more mounting pins adapted to engage said mounting apertures, inserting said mounting pins into said mounting holes, so as to locally deform said foil, allowing said local deformation to locate said component in a plane perpendicular to the direction of insertion, and rigidly securing said printer component to said support.

A second printer component can be mounted to the support in substantially the same way, to secure the first and second components in a fixed spatial relationship. In a preferred embodiment, a printer component can be removed from said support, and the same, or more usefully a replacement component mounted in its place, the replacement component being aligned with respect to the original component, to a high degree of accuracy, preferably +/−5 μm, more preferably +/−2 μm, and more preferably still to an accuracy of +/−1 μm. In an embodiment where the components are printheads mounted on a printbar, printheads can be replaced with sufficient accuracy to enable printing without further adjustment. This method allows printheads to be replaced quickly and easily, without complex alignment steps.

A third aspect of the invention provides a method for manufacturing a support for supporting one or more printer components, the method comprising the steps of providing on the support one or more foil members, each foil member including one or more mounting apertures for engaging with at least one printer component, inserting into at least one mounting aperture on each said foil a mounting pin adapted to engage with said aperture, positioning said one or more foils so as to align said pin or pins in a desired spatial configuration, and securing said foils to said support

BRIEF DESCRIPTION OF THE DRAWINGS

The invention will now be described by way of example only with respect to the accompanying drawings in which.

DETAILED DESCRIPTION

Figure 1:
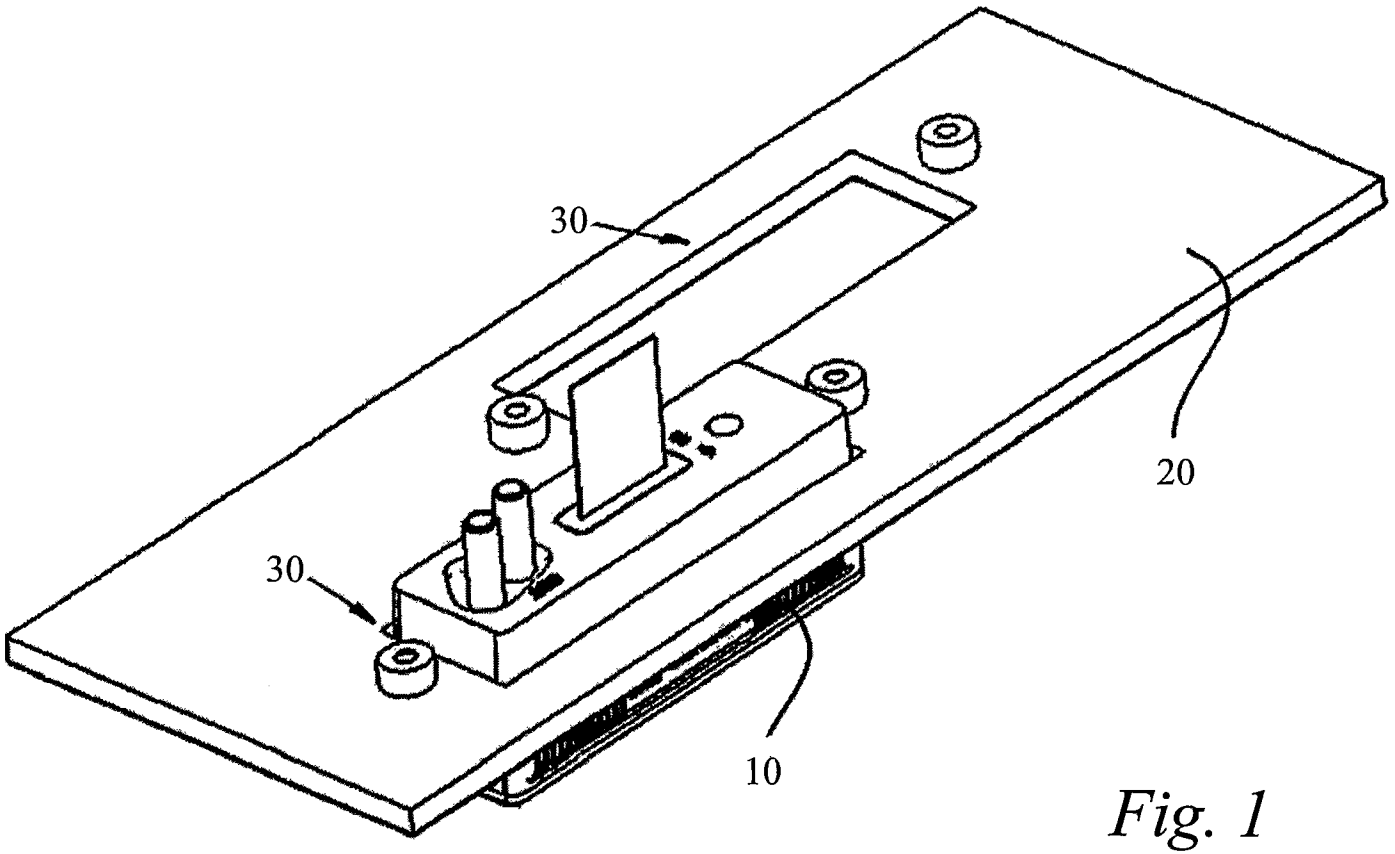
FIG. 1 shows a printhead mounted to a print bar

Referring to FIG. 1, a printhead 10 is attached to a mounting plate 20 which in turn forms part of a printer, not shown. Plate 20 may have multiple printhead mounts as shown at 30 and which are accurately spaced to ensure that the swaths printed by each head are correctly aligned.

It is desirable to be able to remove a printhead 10 from a mount 30 and replace it with another without having to undergo a separate procedure to re-align the replacement printhead with the other printheads in the mounting plate.

Figure 2:
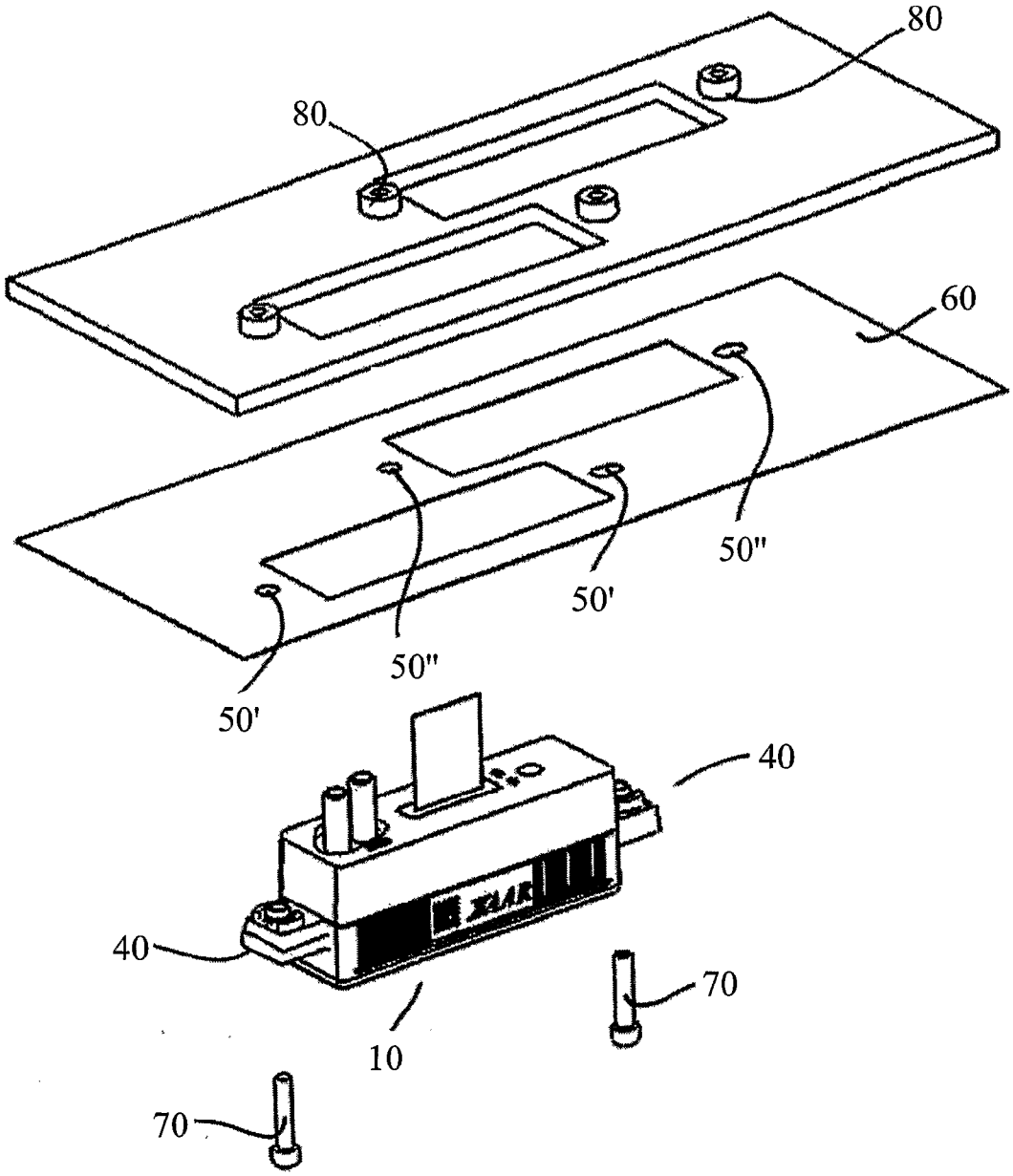
FIG. 2 is an exploded view of FIG. 1

FIG. 2 shows an exploded perspective view of one embodiment for achieving this. Printhead 10 is provided with at least two pin assemblies 40 which engage with corresponding holes 50' formed in a foil 60. Similar holes 50" for engagement with pin assemblies of a second printhead are also formed in the foil, the two pairs of holes being accurately located relative to one another. The manufacture of such accurately located features is easier and cheaper in a foil, e.g. using an optical process, such as photolithographic etching, than it would be, say, in the mount plate. Pin assemblies 40 are drawn into position in the holes 50 e.g. by threaded bolts which pass through the centre of the pins and engage with threads formed in the mounting plate, advantageously as inserts as indicated at 80.

The elastic deflection of the foil, and the resulting locating forces provide alignment to a higher degree of accuracy than might be expected when considering the tolerances of the pins or the hole in the foil. This effect can be exploited in the arrangement shown in FIG. 3.

Figure 3:
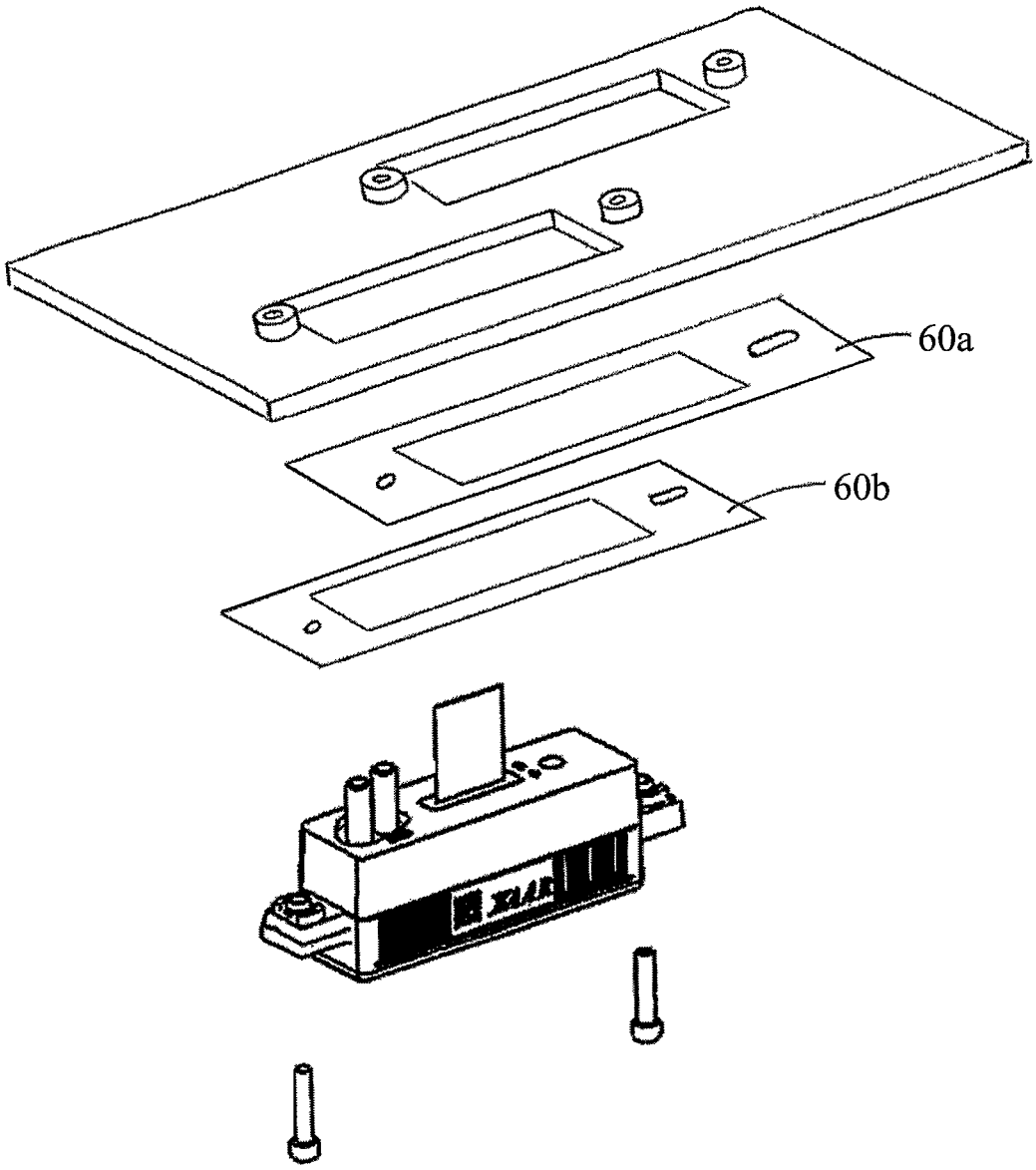
FIG. 3 shows an alternative embodiment to the arrangement of FIG. 2

In an alternative embodiment, shown in FIG. 3, a mount plate is provided with two or more distinct foils 60*a* and 60*b*, rather than a single unitary foil. Each foil includes mounting holes for a single printhead. In order to ensure accurate location of the printheads relative to one another, pins are engaged in the mounting holes, and the pins are then accurately aligned to the desired configuration before the foils are secured to the mount plate. The pins used for this alignment step may be part of a printhead, in which case the nozzles or even the printed swaths of the printheads could be used to determine alignment, or the pins may be part of an alignment tool. The foils are then rigidly fixed to the mount plate by any suitable method, such as by adhesive.

It will be appreciated that a combination of the above embodiments could be employed, using two or more distinct foils, each foil adapted for mounting more than one printhead.

Figure 4:
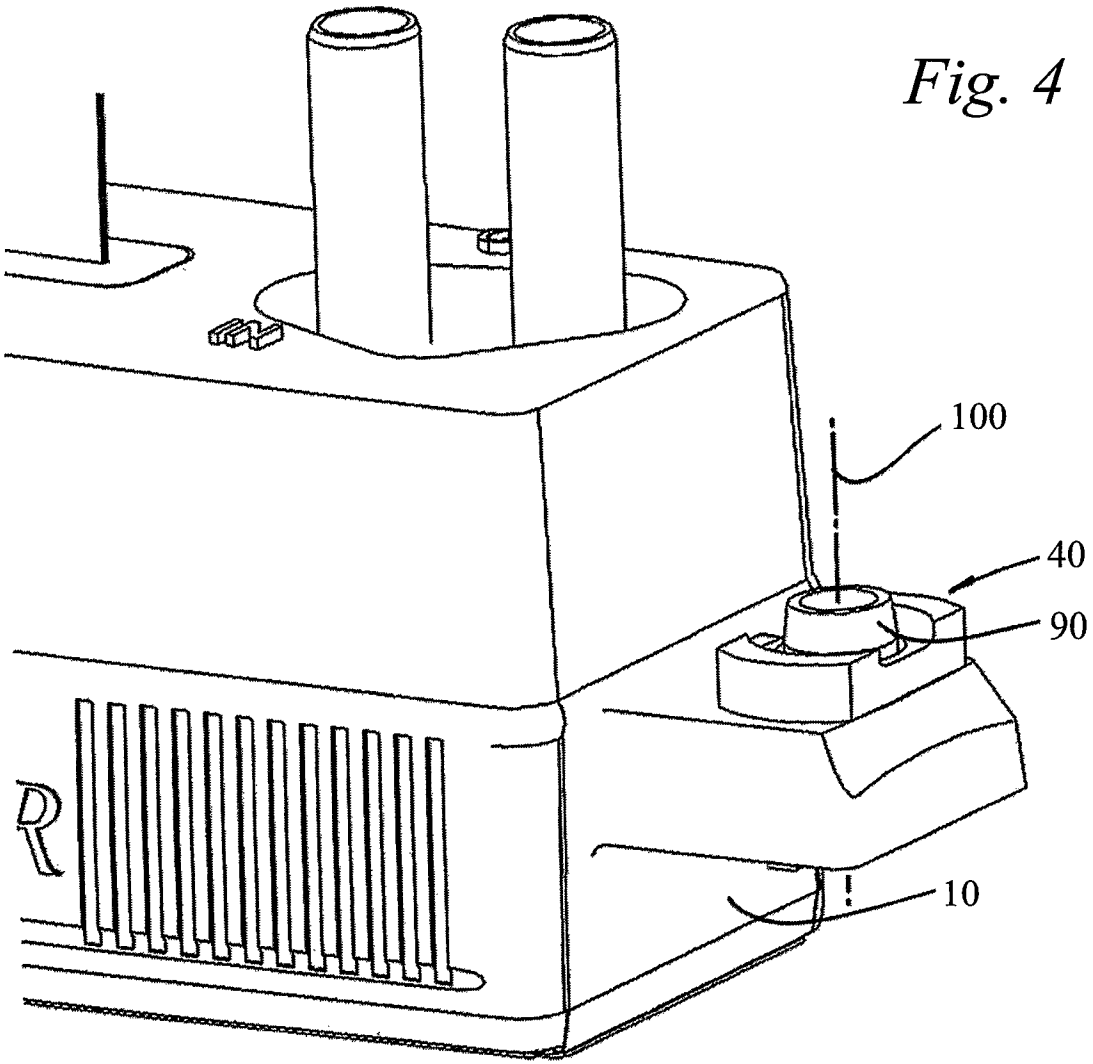
FIG. 4 is a detailed view of a mounting pin
Figure 5:
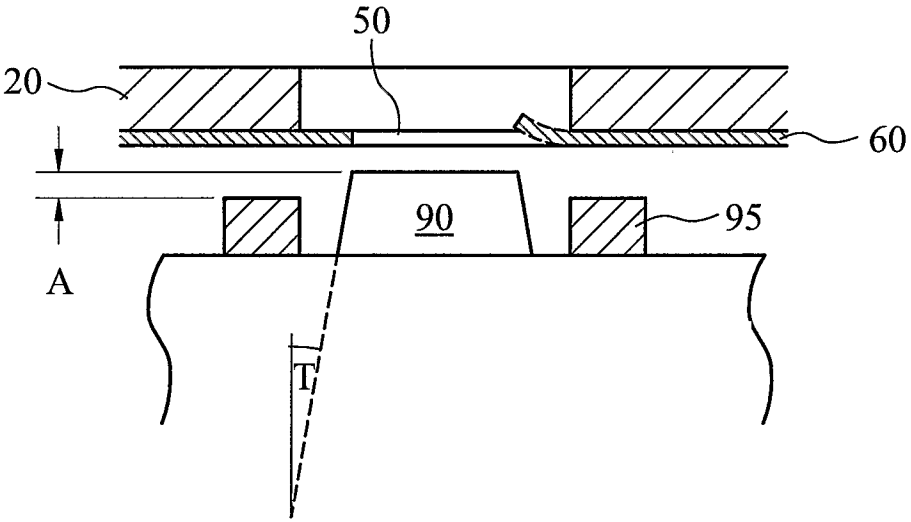
FIG. 5 illustrates deflection of a foil

Detail of the pin assembly is shown in FIG. 4. Tapered sleeve 90 engages with the hole 50 in the foil, thereby accurately locating the pin in the plane perpendicular to the pin axis 100, as will be explained in more detail below. As shown by dashed lines in FIG. 5, foil 60 is deformed by taper 90, resulting in forces which act substantially parallel to the plane of the foil to centre the pin in hole 50. These locating forces can be sufficient to crush dirt or dust that might otherwise cause misalignment. It can be seen from FIG. 5, that the print bar 20 does not come into contact with the sleeve 90, and is sufficiently recessed to allow the foil to deform freely.

Lands 95 accurately located a distance A below the top of the sleeve ensure that the foil is not deformed past its elastic limit. The taper T of the sleeve 90 is typically 5 degrees, resulting in a typical deflection of 0.2 to 0.3 mm of the foil. The print bar is typically 10 mm in thickness.

It has been found that the engagement of pins in a flexible foil as described above can produce alignment to accuracies of plus or minus 2 μm, and in some cases to accuracies of plus or minus 1 μm, or less. Stated differently, a component mounted to a base using such an engagement can be removed and repeatably re-mounted with a positional error of less than 2, or in some cases 1 μm.

These accuracies can be achieved even if the foil and pins themselves are manufactured to lower tolerances, provided that there is an interference fit sufficient to cause local deformation of the foil, resulting in turn in locating forces perpendicular to the direction of motion.

For example, if an aperture in a foil has a diameter of 5.80 mm, +/−0.10 mm, in order to ensure an interference, the diameter of the pin should be at least 5.90 mm. The pin could therefore be specified to a diameter of 5.95+/−0.05 mm. Etching would be a suitable manufacturing process for such components, since it is relatively easy to provide etched parts to tolerances of +/−0.050 mm. These exemplary dimensions and tolerances have been found to provide alignment to an accuracy of approximately +/−5 μm, or +/−0.005 mm. It can therefore be seen that the present invention provides a coupling arrangement which provides alignment between the printer component and the base component with an accuracy approximately ten times greater than the accuracy with which the separate components of that arrangement are formed.

Figure 6:
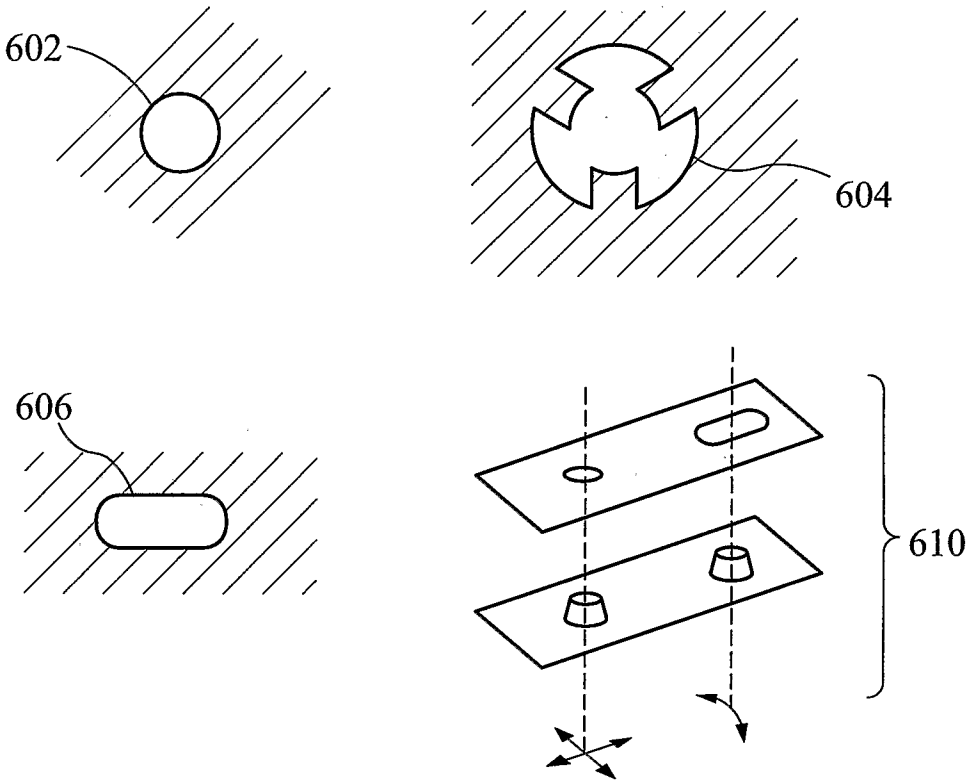
FIG. 6 illustrates foil apertures and configurations

Considering the shape and configuration of the mounting apertures, it can be seen from FIG. 6, that although a substantially circular aperture 602 is preferred for providing lateral alignment in two dimensions (or degrees of freedom), other shapes, such as trefoil arrangement 604 are possible.

As also seen from FIG. 6, a second aperture used for providing alignment in a single degree of freedom preferably takes the form of an elongate slot 606. This shape, used in conjunction with a circle or trefoil, allows the rotation of a component in the plane of the foil to be constrained without over constraining the lateral location, already defined by the circular aperture, as shown at 610.

A further advantage of the present invention is that the pin and foil engagement arrangement does not constrain the component in the direction of insertion, that is, substantially perpendicular to the foil. This allows the remaining degrees of freedom to be constrained by abutment of lands 95 with the foil, without over-constraint from the pins.

Figure 7:
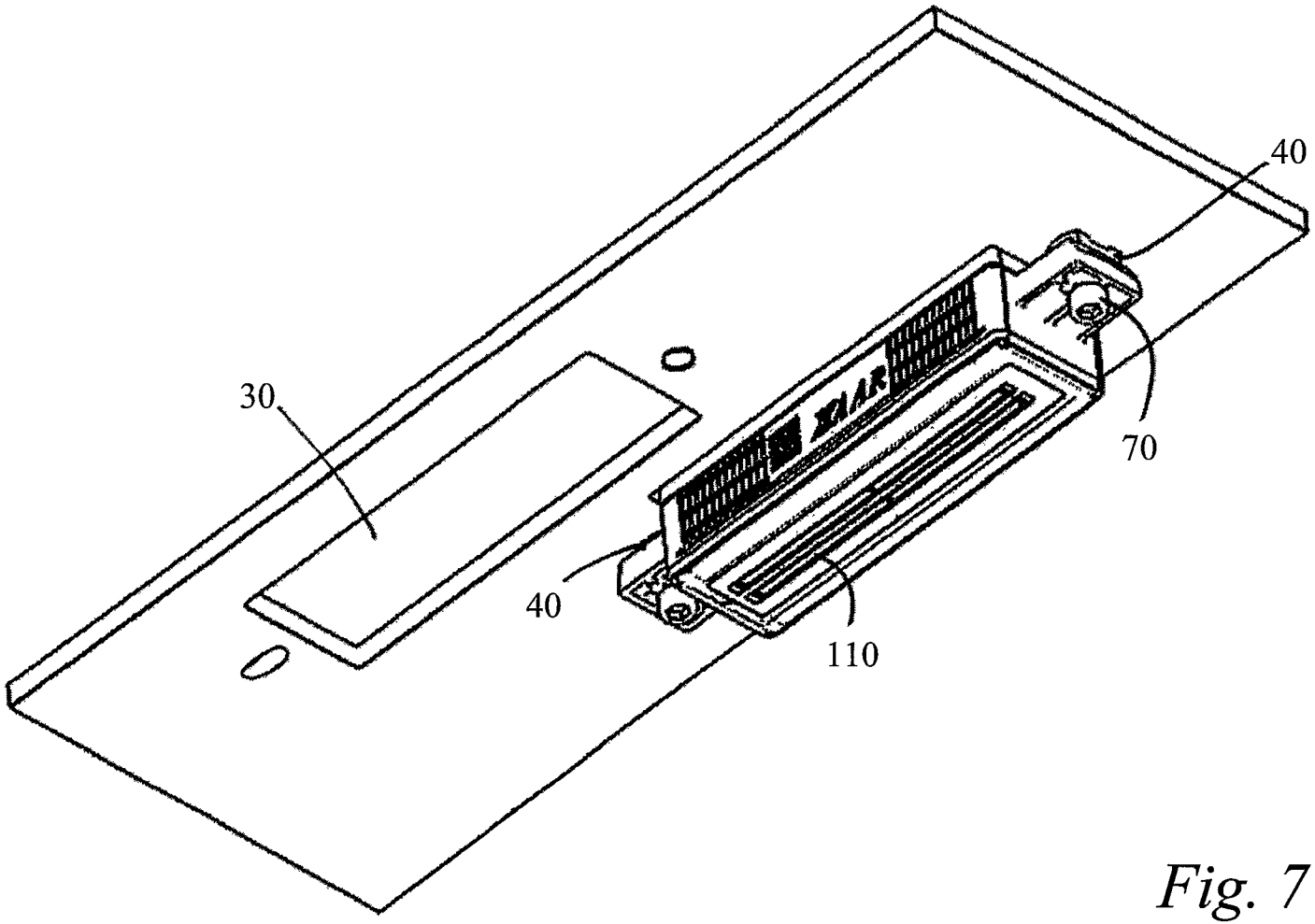
FIG. 7 is an alternative view of the arrangement of FIG. 1

Two such pins 40 positioned, e.g. at either end of a printhead nozzle array 110 as shown in FIG. 7, will therefore accurately locate a printhead in the plane perpendicular to both the pin axis 100 and the printhead nozzle axis, e.g. relative to other printhead mounts 30

Moreover, as long as the foil is not deformed past its plastic limit, such positioning will be repeatable so that a printhead can be removed and a replacement installed in the same position, with a very high degree of accuracy, as noted above. If all printheads are manufactured with identical nozzle positioning relative to the alignment pins, e.g. using the alignment mechanism of the present invention, then the swath printed by the replacement printhead will also be accurately positioned relative to the swaths printed by the other printheads and image quality will be maintained.

It will be appreciated that the invention is not only applicable to the mounting of a printhead in a print bar 20, as described above, but may also be used in the mounting of multiple print bars in a printer and the like.

The invention claimed is:

1. A mounting arrangement for mounting a printer component operable to print one or more swaths of print to a substantially rigid base component which forms part of a printer, said mounting arrangement comprising:

said printer component operable to print one or more swaths of print; a foil member, which is either attached to said printer component, or adapted to be attached to the base component, said foil member including one or more mounting apertures; and one or more mounting pins, which are:

attached to the printer component, where said foil member is adapted to be attached to the base component; or adapted to be attached to the base component, where said foil member is attached to said printer component, said mounting pins being adapted to engage said mounting apertures, wherein engagement of said mounting pins with said mounting apertures causes local deformation of said foil member, said local deformation providing a locating force on said mounting pins so as to urge said printer component into alignment with said foil member, and thereby said base component, in a plane substantially parallel to said foil member.

2. An arrangement according to claim 1, wherein said foil member has a thickness of between 0.1 and 0.5 mm.

3. An arrangement according to claim 1, wherein said foil member is metal.

4. An arrangement according to claim 1, including at least two pins and two mounting apertures.

5. An arrangement according to claim 4, wherein a first pin provides, in combination with said support, alignment in two degrees of freedom.

6. An arrangement according to claim 5, wherein said second pin provides, in combination with said support, alignment in a third degree of freedom.

7. An arrangement according to claim 1, wherein said pins comprise tapered portions, and wherein said locating force is applied to said tapered portions.

8. An arrangement according to claim 1, wherein said printer component is a printhead.

9. An arrangement according to claim 8, wherein a single mounting arrangement is adapted to mount two or more printheads in a fixed spatial relationship.

10. An arrangement according to claim 1, wherein said local deformation is elastic deformation.

11. A method for mounting a first printer component operable to print one or more swaths of print to a support which forms part of a printer, the method comprising:

attaching to one of the printer component or the support a foil member having one or more mounting apertures;

arranging on the other of the printer component or the support one or more mounting pins adapted to engage said mounting apertures;

inserting said mounting pins into said mounting holes, so as to cause local deformation of said foil member;

allowing said local deformation to locate said component in a plane perpendicular to the direction of insertion; and rigidly securing said printer component to said support.

12. A method according to claim 11, wherein said mounting apertures in said foil member are formed by etching.

13. A method according to claim 11, wherein said method locates said printer component to an accuracy of plus or minus 2 μm perpendicular to said direction of insertion.

14. A method according to claim 11, further comprising mounting a second printer component to said support, thereby securing said first and second printer components in a fixed spatial relationship.

15. A method according to claim 11, further comprising removing said printer component from said support, and repeating said method to insert and secure a replacement printhead component.

16. A method for manufacturing a support which forms part of a printer for supporting one or more printer components operable to print one or more swaths of print, the method comprising:

providing one or more foil members, each foil member including one or more mounting apertures for engaging with at least one printer component; providing a substantially rigid base component;

inserting into at least one mounting aperture on each said foil member a mounting pin adapted to engage with said mounting aperture, said mounting pin being inserted in a direction of insertion;

subsequent to said inserting step, positioning said one or more foil members relative to the support in a plane perpendicular to said direction of insertion so as to align said mounting pin or mounting pins in a desired spatial configuration; and then securing said one or more foil members to said substantially rigid base component, wherein a completed support for supporting one or more printer components comprises said one or more foil members and said rigid base component.

17. A method according to claim 16, wherein engagement of said mounting pins with said mounting apertures causes local deformation of said foil member.

18. A method according to claim 16, further comprising forming said one or more mounting apertures in said one or more foil members, wherein said one or more mounting apertures are formed within an accuracy of +/−x μm, wherein said mounting pin or mounting pins are aligned in said desired spatial configuration to within an accuracy of +/−y μm and further wherein x is greater than y and the value of y is 5 μm or less.

19. A method according to claim 16, further comprising forming said one or more mounting apertures in said one or more foil members, wherein said one or more mounting apertures are formed within an accuracy of +/−x μm, wherein said mounting pins are aligned to within an accuracy of +/−y μm, the value of y is 5 μm or less, and wherein x is at least ten times greater than y.

20. A method according to claim 11, further comprising the step of forming said one or more mounting apertures in said one or more foil members, wherein said one or more mounting apertures are formed within an accuracy of +/−x μm, wherein said printer component and said base are aligned to within an accuracy of +/−y μm, the value of y is 5 μm or less, and wherein x is at least ten times greater than y.

21. A method according to claim 11, further comprising the step of forming said one or more mounting apertures in said one or more foil members, wherein said one or more mounting apertures are formed within an accuracy of +/−x μm, wherein said printer component and said base are aligned to within an accuracy of +/−y μm, the value of y is 5 μm or less, and wherein x is of the order of ten times greater than y.

22. A method according to claim 11, wherein said printer component is a printhead comprising a plurality of nozzles, with adjacent nozzles being spaced apart by a nozzle spacing of d μm, wherein said mounting method aligns said printhead to within an accuracy of +/−y μm, and wherein y is less than d and the value of y is 5 μm or less.

23. A method according to claim 16, further comprising, subsequently to said securing step, removing said mounting pin(s) from said at least one mounting aperture on each foil member(s).

24. An arrangement according to claim 1, wherein said locating force increases with increasing depth of engagement of said mounting pins with said mounting apertures.

25. An arrangement according to claim 1, wherein each mounting pin comprises a tapered portion having a length, wherein said foil member has a thickness, and wherein said length of each tapered portion is greater than said thickness of the foil member.

26. A method according to claim 11, wherein said deformation provides a locating force on said mounting pins in a plane substantially parallel to said foil member, and wherein said locating force increases with increasing insertion of said mounting pins into said mounting apertures.

27. A method according to claim 11, wherein each mounting pin comprises a tapered portion, and wherein said step of allowing said local deformation to locate said component in a plane perpendicular to the direction of insertion includes said deformation providing a locating force on each said tapered portion.

28. A method according to claim 11, wherein each mounting pin comprises a tapered portion having a length, wherein said foil member has a thickness, and wherein said length of each tapered portion is greater than said thickness of the foil member.

29. An arrangement according to claim 1, further comprising the substantially rigid base component.

30. An arrangement according to claim 29, wherein the foil member is attached to one of the printer component or the base component and the one or more mounting pins are attached to the other of the printer component and the base component.

31. An arrangement according to claim 30, wherein a single mounting arrangement is adapted to mount two or more printheads in a fixed spatial relationship.

* * * * *

UNITED STATES PATENT AND TRADEMARK OFFICE

CERTIFICATE OF CORRECTION

PATENT NO. : 8,814,451 B2
APPLICATION NO. : 11/815667
DATED : August 26, 2014
INVENTOR(S) : Richard Marsden et al.

It is certified that error appears in the above-identified patent and that said Letters Patent is hereby corrected as shown below:

On the Title Page, in Column 1, below item (65), insert -- (30) Foreign Application Priority Data February 7, 2005 (GB).....0502440.1 --.

Signed and Sealed this
Twenty-ninth Day of September, 2015

Michelle K. Lee

Michelle K. Lee
*Director of the United States Patent and Trademark Office*